US006224411B1

(12) United States Patent
Maag

(10) Patent No.: US 6,224,411 B1
(45) Date of Patent: May 1, 2001

(54) ELECTRICAL ZERO-FORCE CONTACT CONNECTOR DEVICE

(75) Inventor: Arnulf Maag, Alsdorf (DE)

(73) Assignee: ELCO Europe GmbH, Betzdorf (DE)

( * ) Notice: Subject to any disclaimer, the term of this patent is extended or adjusted under 35 U.S.C. 154(b) by 0 days.

(21) Appl. No.: 08/612,718

(22) Filed: Mar. 8, 1996

(30) Foreign Application Priority Data

Mar. 9, 1995 (DE) ..... 195 08 189

(51) Int. Cl.[7] ..... H01R 13/15
(52) U.S. Cl. ..... 439/259; 439/310
(58) Field of Search ..... 439/310, 259, 439/265, 266, 269, 270, 347

(56) References Cited

U.S. PATENT DOCUMENTS

| | | | | |
|---|---|---|---|---|
| 4,392,700 | | 7/1983 | Showman et al. . | |
| 4,705,338 | | 11/1987 | Sitzler . | |
| 5,073,125 | * | 12/1991 | Hashiguchi et al. | 439/259 X |
| 5,411,406 | * | 5/1995 | Kondo | 439/259 X |
| 5,575,676 | * | 11/1996 | Tsukakoshi et al. | 439/347 |

FOREIGN PATENT DOCUMENTS 2707122 9/1977 (DE) .
0273683 7/1988 (EP) .

OTHER PUBLICATIONS

IBM Technical Disclosure Bulletin, Bd. 14, No. 9, Feb. 1972, New York US, pp. 2597–2598, XP002004570 Colletti et al.

* cited by examiner

*Primary Examiner*—Khiem Nguyen
(74) *Attorney, Agent, or Firm*—Friedrich Kueffner

(57) ABSTRACT

An electrical zero-force contact connector device includes two complementary connector components, wherein one connector component is a female multi-point connector with spring contacts and the other connector component is a male multi-point connector with blade contacts. The device further includes an actuating unit for placing the contacts into contact with one another, wherein the actuating unit includes a linearly moveable slide member which interacts with a guide member. The slide member is mounted in one of the connector components and is provided with a web which projects toward the other connector component. The web has at least one oblong hole which extends obliquely relative to the direction of movement of the slide member, wherein the oblong hole receives a transverse bolt of the guide member which can be moved back and forth on the web in a positively guided manner.

6 Claims, 5 Drawing Sheets

ELECTRICAL ZERO-FORCE CONTACT CONNECTOR DEVICE

BACKGROUND OF THE INVENTION

1. Field of the Invention

The present invention relates to an electrical zero-force contact connector device composed of two complementary connector components, wherein one connector component is constructed, for example, as a female multi-point connector with spring contacts and the other connector component is constructed, for example, as a male multi-point connector with blade contacts. The device further includes an actuating unit for placing the contacts into contact with one another, wherein the actuating unit includes a linearly moveable slide member which interacts with a guide member.

2. Description of the Related Art

In known electrical contact connector devices of this type, the contact elements are arranged in a row of base elements or in several parallel rows of base elements and the contact elements can be placed in and out of contact in the connected state of the two connector components by means of adjusting sliders which are displaceable along the row or rows of base elements.

The characteristic feature of such zero-force contact connector devices is the fact that the two connector components can be connected to each other and disconnected from each other without having to overcome any contact pressure forces of the contact elements which are placed into contact with one another. The contact elements are constructed, for example, as so-called blade contacts which are arranged in the stationary connector component. On the other hand, the contact elements arranged in the moveable connector component are preferably constructed as spring contacts. The contact connector device ensures that the two connector components are always coupled to one another in a positively engaging manner, as long as the contact elements are in contact with each other as a result of the spring forces; moreover, it is also ensured that the two connector components can only be connected and disconnected when the contact elements are not in contact with one another.

In a zero-force contact connector of the above-described type disclosed in German Patent 27 07 122, the spring contacts and the blade contacts are each supported by base elements in housings and/or on strips which can be connected to one another while guiding each other and in which the corresponding contact elements can be placed in and out of contact by actuating a slide member. For this purpose, the slide member guided on the contact support has a guide duct into which projections of cam members project during displacement and which, in the end position thereof, place the spring contacts in contact with the blade contacts.

It is also known in the art to form a connector component by a printed circuit board which can be moved with its contact elements through a longitudinal slot of the other connector component into the area of the contact elements, for example, the spring contacts.

SUMMARY OF THE INVENTION

Therefore, it is the primary object of the present invention to provide an electrical zero-force contact connector device of the above-described type which is of simple construction and offers improved operational safety.

In accordance with the present invention, the slide member is mounted in one of the connector components and is provided with a web which projects toward the other connector component. The web has at least one oblong hole which extends obliquely relative to the direction of movement of the slide member, wherein the oblong hole receives a transverse bolt of a guide member which can be moved back and forth on the web in a positively guided manner.

Except for the actuating unit for introducing the force for displacing the slide member, for example, a hand lever or a type of rack drive, which is located outside of the connected connector components, the configuration of the present invention makes it possible that the entire mechanism for effecting movements is enclosed; this is because the mechanism is located in the space between the connected connector components.

When the slide member which extends over the entire length of the connector and is guided in the connector component constructed as a male multi-point connector is displaced, the linear movement of the slide member is converted into a movement which, depending on the connector arrangement, is directed vertically or at least in a direction perpendicular to the slide member movement. This is achieved by the at least one obliquely extending oblong hole provided in the projecting web, wherein the oblong hole forces the slide member to carry out the above-described movement because of the engagement of the transverse bolt in the oblong hole. In the end position of the guide member, the contact between the spring contacts and the blade contacts is effected.

The web of the slide member is advantageously provided with two obliquely extending oblong holes which are arranged at a distance one behind the other and which each receive a transverse bolt of the guide member. The resulting guidance at two points stabilizes the sequence of movement and ensures that the guide member displaceable in the oblong holes of the web is uniformly moved up or to the side.

In accordance with another proposal of the present invention, the slide member has a T-shaped cross-section and is guided with a slide member base extending transversely of the slide member web in a longitudinal groove of the bottom or base of the connector component. In the position in which no contact exists between the contacts, the slide member base projects in the shape of a tongue out of the longitudinal groove on the side of the contact connector arrangement facing away from the actuating side, while the slide member web remains without change in its position enclosed between the two connector components; together with the slide member base, the web projects only out of the connector arrangement in the manner of a lever on the actuating side.

In accordance with another proposal, guide slots are provided in the guide member for the spring contacts of the female multi-point connector, wherein a wall portion of each slot adjacent the spring contacts is provided with an inclined surface which rises in the direction of movement of the contacts. Because of the rising configuration of this inclined surface, a bent spring web of the head of the spring contact constructed in the shape of an eye is increasingly pressed against the corresponding blade contacts when the connector components are connected, wherein a slight frictional movement between the spring contacts and the blade contacts is an advantage in the case of corrosive surfaces; as soon as the spring contact has overcome the inclined surface, the spring contact rests against the corresponding blade contact and the contact is closed.

In accordance with a preferred feature, the inclined surface of the slot wall is followed by a trough which locks the spring contact in the end position. This makes it possible to achieve an end position of the connected contacts which is independent, for example, of vibrations or oscillations and, thus, the desired contact is safely ensured.

A further development of the present invention provides that the lower ends of the blade contacts extend essentially to the bottom edge of the housing of the male multi-point connector. Thus, when the male and female multi-point connectors are connected, the danger of deformation of the plate contacts is reduced or even eliminated because the blade contacts can rest over this entire length of the blade contacts against the inner wall of the male multi-point connector or the contact housing.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENT

Figure 2:
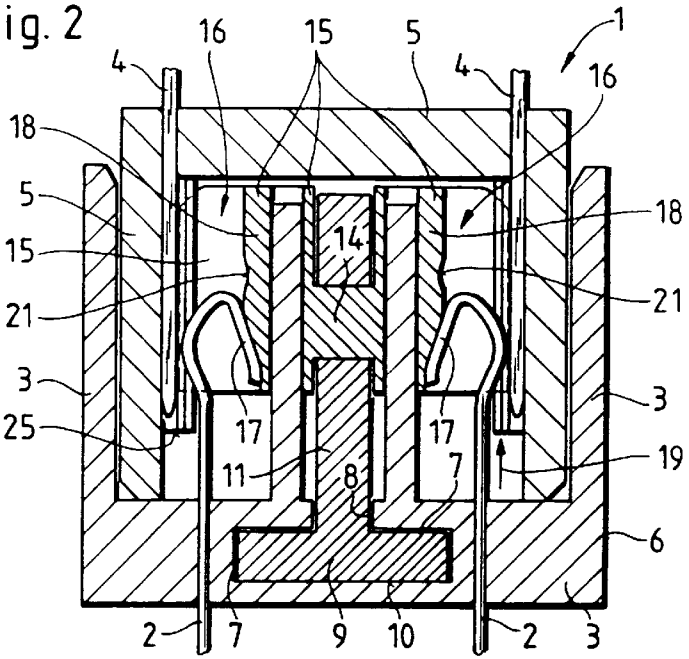
FIG. 2 is a sectional view, on a larger scale, taken along sectional line II—II of FIG. 1.
Figure 4:
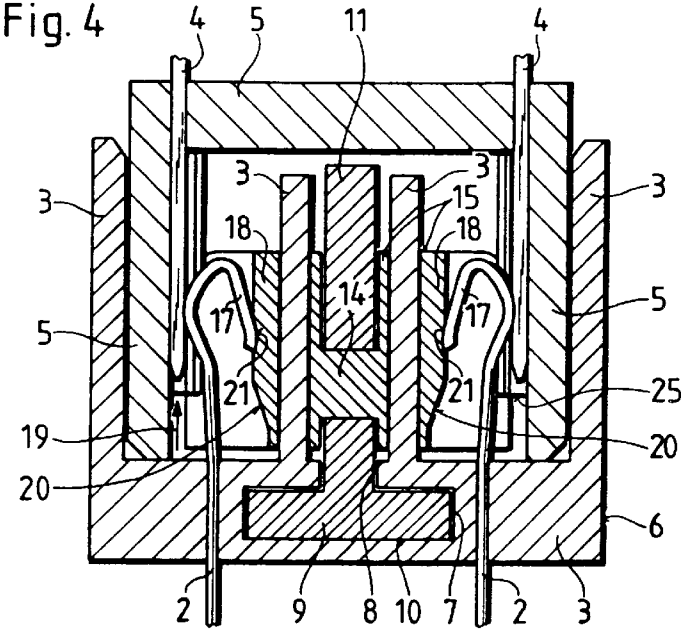
FIG. 4 is a sectional view, on a larger scale, taken along sectional line IV—IV of FIG. 3.
Figure 6:
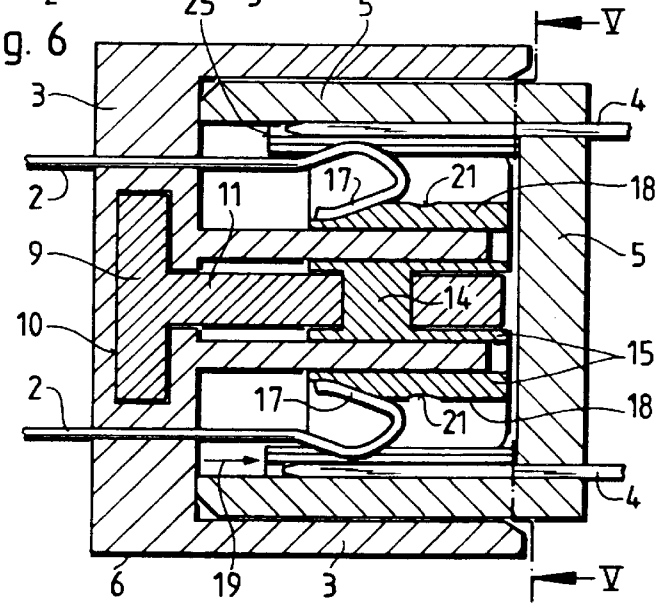
FIG. 6 is a sectional view, on a larger scale, of a zero-force contact connector device turned toward the right by 90° relative to the embodiment of FIG. 1.

As illustrated in the drawing, a zero-force contact connector device 1 is composed of a connector component 3 constructed as a female multi-point connector with spring contacts 2 and a connector component 5 constructed as a male multi-point connector with blade contacts 4, as particularly shown in FIGS. 2, 4 and 6. The oblong, rectangular connector component 5 which has a U-shaped cross-section is inserted with its open side into the connector component 3 which faces the connector component 2 and has a corresponding shape, i.e., it has a U-shaped cross section, so that an outwardly closed contact connector device 1 is provided.

Figure 5:
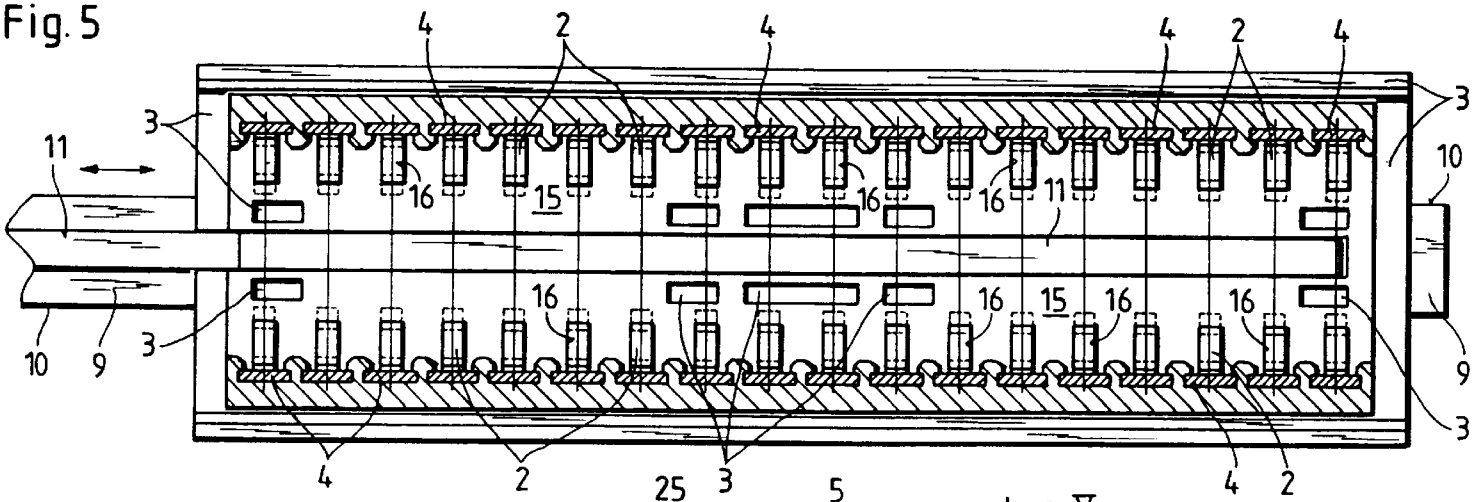
FIG. 5 is a sectional view taken along sectional line V—V of FIG. 6.

The base or bottom 6 of the connector component 3 has a longitudinal groove 7 which extends in longitudinal direction over the entire length of the connector component 3. The longitudinal groove 7 is provided with a slot 8 which extends at a right angle to the longitudinal groove 7 and is open toward the connector component 5 in the assembled position. The slide member base 7 of a slide member 10 having a T-shaped cross section is guided in the longitudinal groove 7. The slide member 10 has a slide member web 11 which extends through the slot 8 and protrudes in the direction toward the connector component 5. The slide member web 11 has two obliquely extending oblong holes 12 and 13 which are arranged at a distance one behind the other and serve to receive transverse bolts 14 of a guide member 15. As shown in FIG. 5, the guide member 15 is provided with guide slots 16 which are distributed over the length of the guide member 15, wherein the number of guide slots 16 corresponds to the number of spring contacts 2 and blade contacts 4 and wherein the spring contacts 2 extend into the guide slots 16.

The heads of the spring contacts 2 which are inserted into the guide slots 16 of the guide member 15 are constructed in the shape of eyes. The heads rest with bent, free spring webs 17 against the slot wall 18 of the guide slot 16 of the guide member 15. As shown, for example, in FIG. 4, the slot walls 18 have an inclined surface 20 which rises in the direction of movement of the contacts, as indicated by arrows 19 in FIGS. 2, 4 and 6. Behind and at a slight distance from the inclined surface 20, the slot walls 18 have a recess or trough 21, shown in FIGS. 2 and 6, for defining an end position of the contacts.

Figure 7:
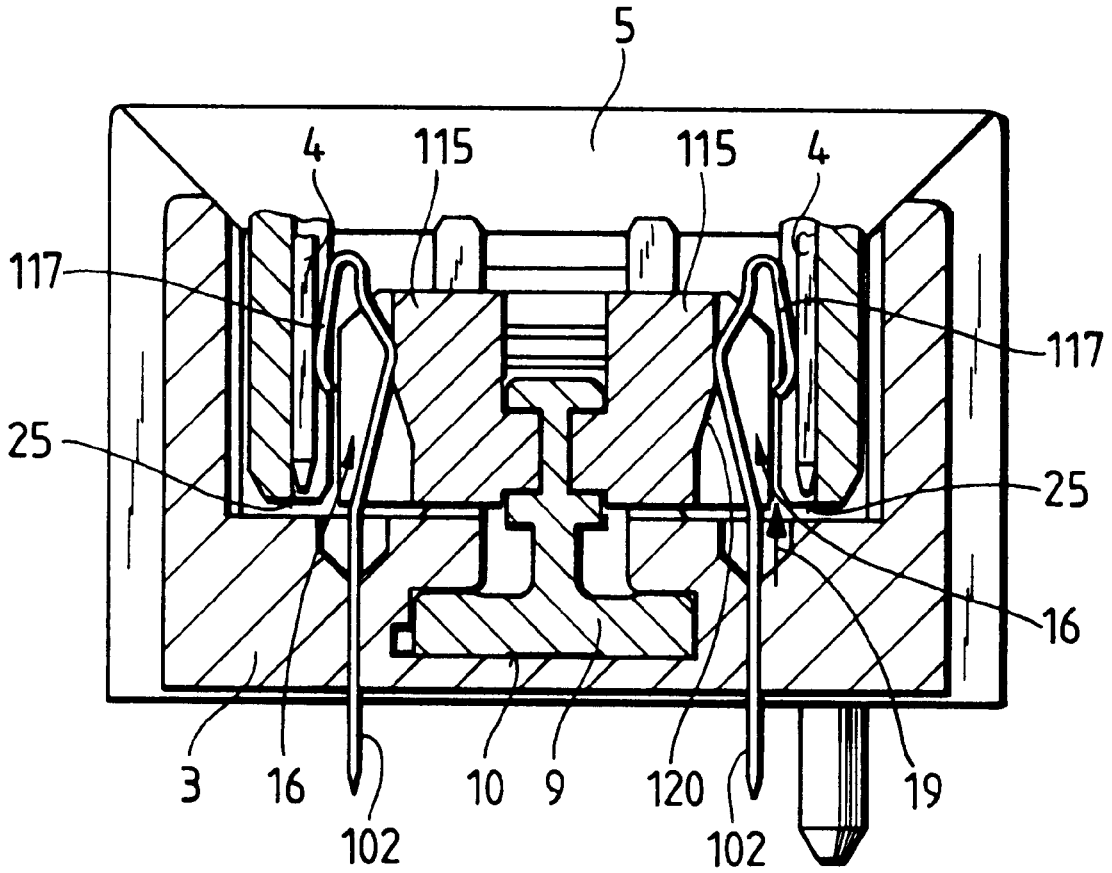
FIG. 7 is a sectional view of another embodiment of the zero-force contact connector device.

FIG. 7 of the drawing shows a zero-force contact connector device which is of a modified construction as compared to the device of FIG. 4. As is the case in FIG. 4, FIG. 7 shows the contact position of the connector device. In the embodiment of FIG. 7, the spring contacts 102 are turned by 180° relative to the embodiment shown in FIGS. 1–6, so that, in this case, the free eye-like bent spring webs 117 rest against the blade contacts 4 which also extend close to the bottom edge 25 of the housing of the connector component 5 and press the blade contacts 4 against the inner wall of the housing the connector component 5. The guide member 115 is provided with the inclined surfaces 120 which force the spring contacts 102 into the contact position in the guide slots 16 of the guide member 115 when the connector component 3 and the connector component 5 are connected.

Figure 1:
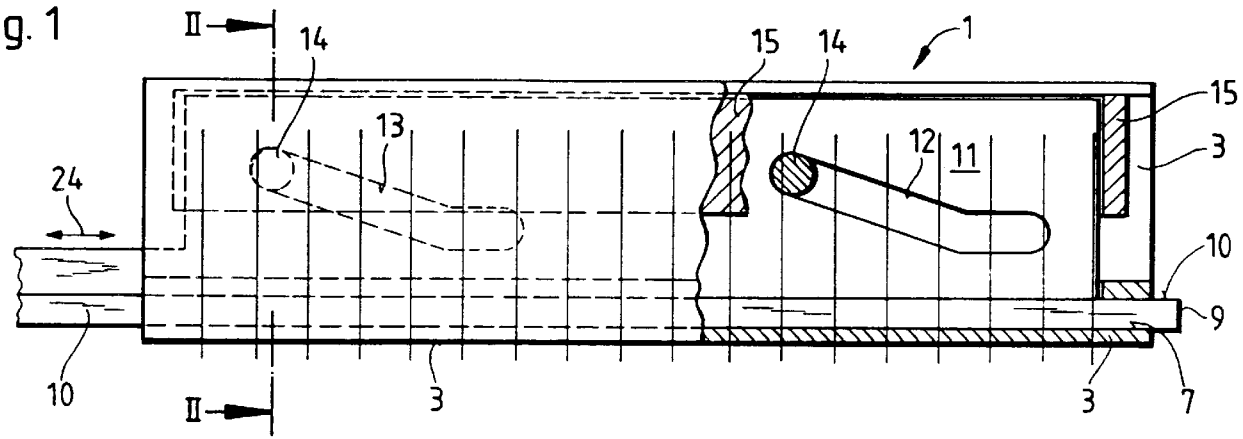
FIG. 1 is a partial longitudinal sectional view of a zero-force contact connector device with the connector components being connected, but in a non-contact position.

In the position shown in FIGS. 1 and 2 as well as 5 and 6 (FIGS. 5 and 6 differ from FIGS. 1 and 2 only in that the mounting position of the connector components 3 and 5 are turned by 90°), the blade contacts 4 are not in contact with the spring contacts 2. The spring webs 17 of the spring contacts 2 rest against the inclined surfaces 20 of the slot walls 18 of the guide slots 16 in the guide member 15. The transverse bolts 14 of the guide member 15 received in the oblong holes 12, 13 of the slide member web 12 assume the position in the left, upper end of the oblong holes 12, 13 as shown in FIG. 1.

Figure 3:
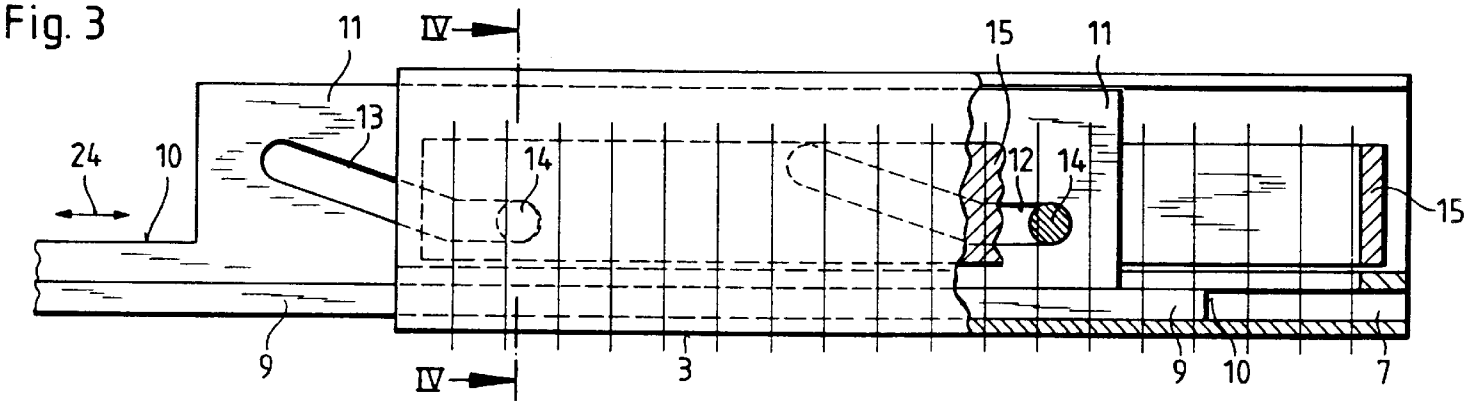
FIG. 3 is a longitudinal sectional view of the zero-force contact connector device according to FIG. 1 in the contact position.
Figure 8:
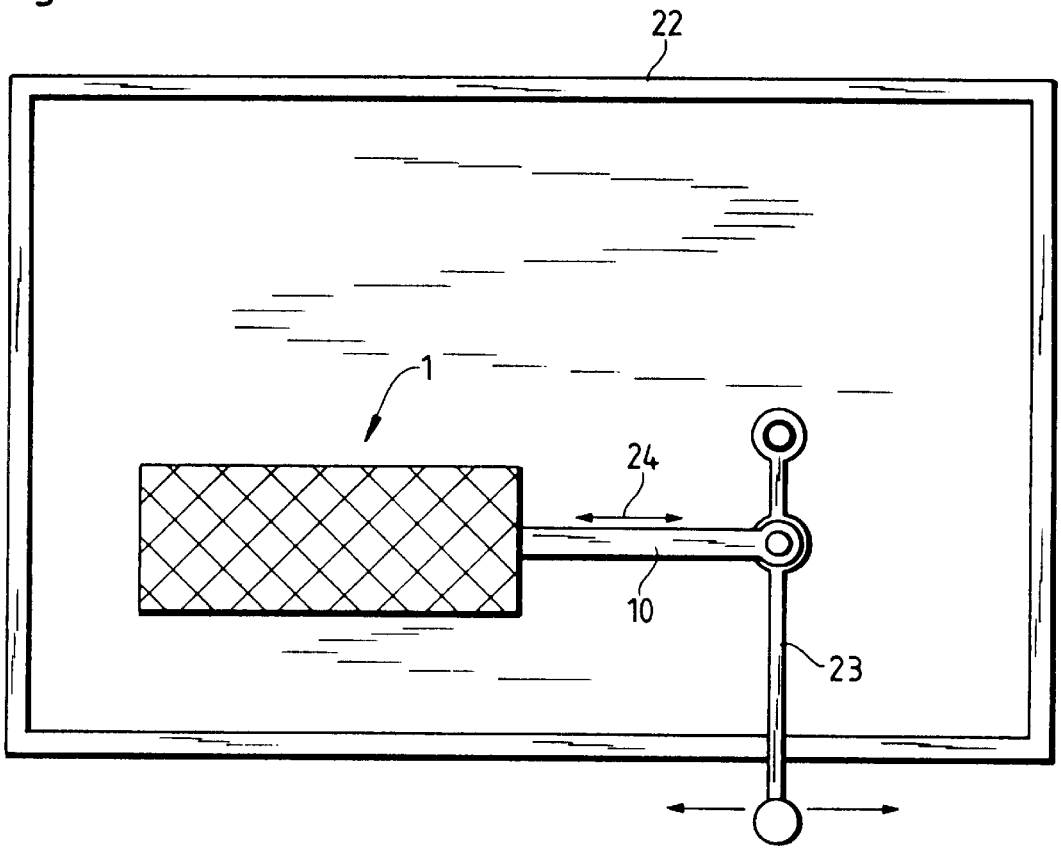
FIG. 8 is a schematic illustration of a mounting example for a zero-force contact connector device.

In the embodiment shown in FIG. 8, the contact is effected by moving an actuating lever 23 to be grasped by the operator and connected to the slide member 10 in an articulated manner into a position of operation. The lever 23 extends into a housing 22, for example, an instrument display of motor vehicle, which is not accessible from the outside and in which the zero-force contact connector device 1 is mounted. By displacing the lever 23 in the direction toward the left as indicated by the double arrow 24 in FIG. 1, the slide member 10 is displaced in the longitudinal groove 7 in such a way that it is moved in the direction of movement toward the left out of the connected housings of the contact connector device 1, wherein, as shown in FIG. 3, the transverse bolts 14 of the guide member 15 are displaced downwardly because of the positive guidance in the corresponding oblong holes 12, 13. In the illustrated position, the transverse bolts 14 are in a straight end portion of the oblong holes 12, 13 which otherwise extend obliquely.

Simultaneously with the linear movement of the slide member 10, the guide member 15 is moved downwardly in a direction extending at a right angle relative to the movement of the slide member 10, as shown in FIG. 4, or toward the left as shown in FIG. 6. Consequently, the spring webs 17 of the spring contacts 2 are displaced relative to the inclined surfaces 20 of the slot walls 18 of the guide slots 16 and, as soon as the inclined surfaces 20 are overcome, the free ends of the spring contacts 2 engage in the troughs 21 which define the end position, as shown in FIG. 4. In this position, the contact between the spring contacts 2 and the blade contacts 4 is fully effected. Only when the actuating lever 23 is moved toward the right as indicated by the double arrow 24 in FIGS. 1 and 3, the contacts are moved apart from one another. Consequently, the contact can be effected and released by actuating the linearly moveable slide member 10 because of the movement of the guide member 15 in the space between the connector component 3 and the connector component 5 and the positive guidance in the oblong holes 12, 13 of the web 11 as the slide member is moved up and down or back and forth.

While specific embodiments of the invention have been shown and described in detail to illustrate the inventive principles, it will be understood that the invention may be embodied otherwise without departing from such principles.

I claim:

1. In an electrical zero-force contact connector device including first and second complementary connector components, wherein the first connector component is a female multi-point connector with a number of spring contacts and the second connector component is a male multi-point connector with blade contacts, the device further including an actuating unit for placing the spring contacts and the blade contacts in contact with one another, wherein the actuating unit includes a guide member and a linearly moveable slide member in engagement with the guide member, the guide member having a length, the improvement comprising the slide member being mounted centrally in the first connector component and comprising a web which projects toward the second connector component, the web having at least one oblong hole extending obliquely relative to a direction of movement of the slide member, the slide member being mounted so as to be moveable in a sliding direction back and forth on the web in a positively guided manner, the guide member having a transverse bolt, wherein the oblong hole receives the transverse bolt of the guide member, the guide member comprising a number of laterally arranged guide slots, the number of guide slots corresponding to the number of spring contacts, the guide slots being distributed over the length of the guide member and being open toward a side facing the blade contacts, the guide slots being configured to receive the spring contacts of the first connector component such that the spring contacts rest against the blade contacts at a right angle relative to the sliding direction of the slide member.

2. The zero-force contact connector device according to claim 1, wherein the web has two oblong holes extending obliquely relative to the direction of movement of the slide member and spaced apart from one another in the direction of movement of the slide member, the guide member having two transverse bolts, wherein each oblong hole receives one of the transverse bolts.

3. The zero-force contact connector device according to claim 1, wherein the slide member has a T-shaped cross section forming the web and a base extending transversely of the web, the first connector component having a bottom defining a longitudinal groove, wherein the base of the slide member is guided in the longitudinal groove.

4. The zero-force contact connector device according to claim 1, the guide slots having wall surfaces for contacting the spring contacts, each wall surface having an inclined wall surface portion which rises in a direction of insertion of the spring contacts.

5. The zero-force contact connector device according to claim 4, wherein each wall surface has a trough located behind the inclined wall surface portion in the direction of insertion for locking the spring contact in an end position.

6. The zero-force contact connector device according to claim 1, wherein the second connector component comprises a housing having a lower edge, and wherein the blade contacts extend with lower ends thereof essentially to the lower edge of the housing.

* * * * *